US009443470B2

(12) United States Patent
Kim et al.

(10) Patent No.: US 9,443,470 B2
(45) Date of Patent: Sep. 13, 2016

(54) ORGANIC LIGHT EMITTING DISPLAY DEVICE AND METHOD OF DRIVING ORGANIC LIGHT EMITTING DISPLAY DEVICE

(71) Applicant: SAMSUNG DISPLAY CO., LTD., Yongin, Gyeonggi-Do (KR)

(72) Inventors: Jeon-Kyoo Kim, Suwon-si (KR); Kyung-Youl Min, Hwaseong-si (KR); Choong-Sun Shin, Yongin-si (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 62 days.

(21) Appl. No.: 14/598,461

(22) Filed: Jan. 16, 2015

(65) Prior Publication Data

US 2016/0035280 A1 Feb. 4, 2016

(30) Foreign Application Priority Data

Jul. 30, 2014 (KR) ..... 10-2014-0097060

(51) Int. Cl.
*G09G 3/32* (2016.01)
*G09G 3/00* (2006.01)

(52) U.S. Cl.
CPC .... *G09G 3/3233* (2013.01); *G09G 2310/0243* (2013.01); *G09G 2320/048* (2013.01)

(58) Field of Classification Search
CPC .. G09G 3/3225; G09G 3/325; G09G 3/3233; G09G 3/3291; G09G 3/006
See application file for complete search history.

(56) References Cited

U.S. PATENT DOCUMENTS

| | | | | |
|---|---|---|---|---|
| 9,280,933 | B2 * | 3/2016 | Chaji | G09G 3/3233 |
| 2009/0309818 | A1 * | 12/2009 | Kim | G09G 3/3233 345/77 |
| 2010/0013867 | A1 | 1/2010 | Kim | |
| 2010/0079420 | A1 * | 4/2010 | Takei | G09G 3/3291 345/204 |
| 2011/0050744 | A1 * | 3/2011 | Kikuta | G09G 3/3233 345/690 |
| 2011/0130981 | A1 * | 6/2011 | Chaji | G09G 3/006 702/58 |
| 2011/0210958 | A1 * | 9/2011 | Yoo | G09G 3/325 345/214 |
| 2013/0050292 | A1 | 2/2013 | Mizukoshi | |
| 2013/0162617 | A1 | 6/2013 | Yoon et al. | |
| 2015/0356899 | A1 * | 12/2015 | Yamanaka | G09G 3/3225 345/690 |

FOREIGN PATENT DOCUMENTS

| | | | |
|---|---|---|---|
| KR | 10-2007-0019461 | A | 2/2007 |
| KR | 10-2010-0008908 | A | 1/2010 |
| KR | 10-2010-0077043 | A | 7/2010 |
| KR | 10-2013-0024744 | A | 3/2013 |
| KR | 10-2014-0034373 | A | 3/2014 |

* cited by examiner

*Primary Examiner* — Lin Li
(74) *Attorney, Agent, or Firm* — Lee & Morse, P.C.

(57) ABSTRACT

An organic light emitting display device includes a display panel, current measuring circuits, and a timing controller. The display panel includes a plurality of pixel blocks. The current measuring circuits measure driving currents of pixels in the pixel blocks. The timing controller adjusts data signals applied to the pixels based on values measured by the current measuring circuits. One of the current measuring circuits measure driving currents of the pixels in a corresponding one of the pixel blocks, and also a driving current of at least one overlapped pixel.

20 Claims, 4 Drawing Sheets

100

ORGANIC LIGHT EMITTING DISPLAY DEVICE AND METHOD OF DRIVING ORGANIC LIGHT EMITTING DISPLAY DEVICE

CROSS REFERENCE TO RELATED APPLICATION

Korean Patent Applications No. 10-2014-0097060, filed on Jul. 30, 2014, and entitled, "Organic Light Emitting Display Device and Method of Driving Organic Light Emitting Display Device," is incorporated by reference herein in its entirety.

BACKGROUND

1. Field

One or more embodiments described herein relate to an organic light emitting display device and a method for driving an organic light emitting display device.

2. Description of the Related Art

An organic light emitting display uses organic light emitting diodes (OLEDs) to emit light. The luminance of light from each OLED depends on driving current. Generally, luminance increases as driving current increases. The driving current may be generated by a driving transistor in each pixel. Over time, the driving transistor deteriorates. As a result, the driving current output from the driving transistor decreases to degrade display quality.

A current measuring unit has been proposed to include semiconductor elements. The measuring capability of such a current measuring unit may differ based on semiconductor manufacturing environment. As a result, measured values output from multiple current measuring units may differ from each other.

SUMMARY

In accordance with one embodiment, an organic light emitting display device includes a display panel including first to (n)th pixel blocks, each of the first to (n)th pixel blocks having a plurality of pixels and where n>1; first to (n)th current measuring circuits respectively connected to the first to nth pixel blocks, the first to (n)th current measuring circuits to measure driving currents of the pixels in the first to (n)th pixel blocks, respectively; and a timing controller to adjust data signals applied to the pixels based on values measured by the first to (n)th current measuring circuits, wherein a (k)th current measuring circuit among the first to (n)th current measuring circuits is to measure driving currents of the pixels in a (k)th pixel block among the first to (n)th pixel blocks, and is to measure a driving current of at least one overlapped pixel among the pixels in a (k+1)th pixel block that is adjacent to the (k)th pixel block, where 0<k<n.

The timing controller may adjust the data signals based on the values measured by the first to (n)th current measuring circuits to compensate a change of the driving current of each of the pixels. The timing controller may adjust a driving current applying time within one horizontal period by adjusting the data signals, wherein the driving current applying time may include a duration of time during which the driving current is applied to an organic light emitting diode (OLED) in each of the pixels. The timing controller may adjust respective voltage levels of the data signals.

The device may include first to (n)th data drivers respectively connected to the first to nth pixel blocks, the first to (n)th data drivers to apply the data signals to the pixels in respective ones of the first to (n)th pixel blocks. The pixels in the first to (n)th pixel blocks may receive the data signals from the first to (n)th data drivers through respective data lines, respectively, and the first to (n)th current measuring circuits may measure the driving currents via the data lines. The (k)th current measuring circuit may measure the driving current of the at least one overlapped pixel via at least one data line corresponding to the (k+1)th pixel block.

The timing controller may determine a driving current determining value for the overlapped pixel based on a value of the overlapped pixel measured by the (k)th current measuring circuit and a value of the overlapped pixel measured by a (k+1)th current measuring circuit adjacent to the (k)th current measuring circuit, wherein a data signal to be applied to the overlapped pixel may be adjusted based on the driving current determining value.

The timing controller may determine the driving current determining value between the value measured by the (k)th current measuring circuit and the value measured by the (k+1)th current measuring circuit, and a difference between the driving current determining value and the value measured by the (k)th current measuring circuit may decrease as a distance between the overlapped pixel and the (k)th pixel block decreases.

The timing controller may determine the driving current determining value based on a sum of a first value and a second value, the first value may be determined based on a product of the value measured by the (k)th current measuring circuit by a first weight, the second value may be determined based on a product of the value measured by the (k+1)th current measuring circuit by a second weight, the first weight increases as a distance between the overlapped pixel and the (k)th pixel block decreases, and the second weight increases as the distance between the overlapped pixel and the (k)th pixel block increases.

In accordance with another embodiment, a method for driving an organic light emitting display device includes measuring driving currents of pixels in first to (n)th pixel blocks of the display device using first to (n)th current measuring circuits, respectively; and adjusting data signals applied to the pixels based on values measured by the first to (n)th current measuring circuits, wherein a (k)th current measuring circuit among the first to (n)th current measuring circuits is to measure driving currents of the pixels in a (k)th pixel block among the first to (n)th pixel blocks, and is to measure a driving current of at least one overlapped pixel among the pixels in a (k+1)th pixel block that is adjacent to the (k)th pixel block, where 0<k<n.

Adjusting the data signals may include adjusting the data signals based on the values measured by the first to (n)th current measuring circuits, to compensate a change of the driving current of each of the pixels. The method may include adjusting a driving current applying time within one horizontal period by adjusting the data signals, wherein the driving current applying time includes a time having a duration during which the driving current is applied to an organic light emitting diode (OLED) in each of the pixels. The respective voltage levels of the data signals may be adjusted.

The method may include applying the data signals to the pixels in the first to (n)th pixel blocks from first to (n)th data drivers, respectively. The pixels in the first to (n)th pixel blocks may receive the data signals from the first to (n)th data drivers through a plurality of data lines, respectively, and the first to (n)th current measuring circuits may measure the driving currents via the data lines. The method may include measuring the driving current of the at least one overlapped pixel using the (k)th current measuring circuit, the driving current of the at least one overlapped pixel measured via at least one data line corresponding to the (k+1)th pixel block.

The method may include determining a driving current determining value for the overlapped pixel based on a value of the overlapped pixel measured by the (k)th current measuring circuit and a value of the overlapped pixel measured by a (k+1)th current measuring circuit adjacent to the (k)th current measuring circuit, wherein a data signal applied to the overlapped pixel is adjusted based on the driving current determining value.

The method may include determining the driving current between the value measured by the (k)th current measuring circuit and the value measured by the (k+1)th current measuring circuit, wherein a difference between the driving current determining value and the value measured by the (k)th current measuring circuit decreases as a distance between the overlapped pixel and the (k)th pixel block decreases.

The method may include determining a first value based on a product of the value measured by the (k)th current measuring circuit and a first weight, determining a second value based on a product of the value measured by the (k+1)th current measuring circuit by a second weight, and determining the driving current determining value based on a sum of the first value and the second value, wherein the first weight increases as a distance between the overlapped pixel and the (k)th pixel block decreases, and wherein the second weight increases as the distance between the overlapped pixel and the (k)th pixel block increases.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
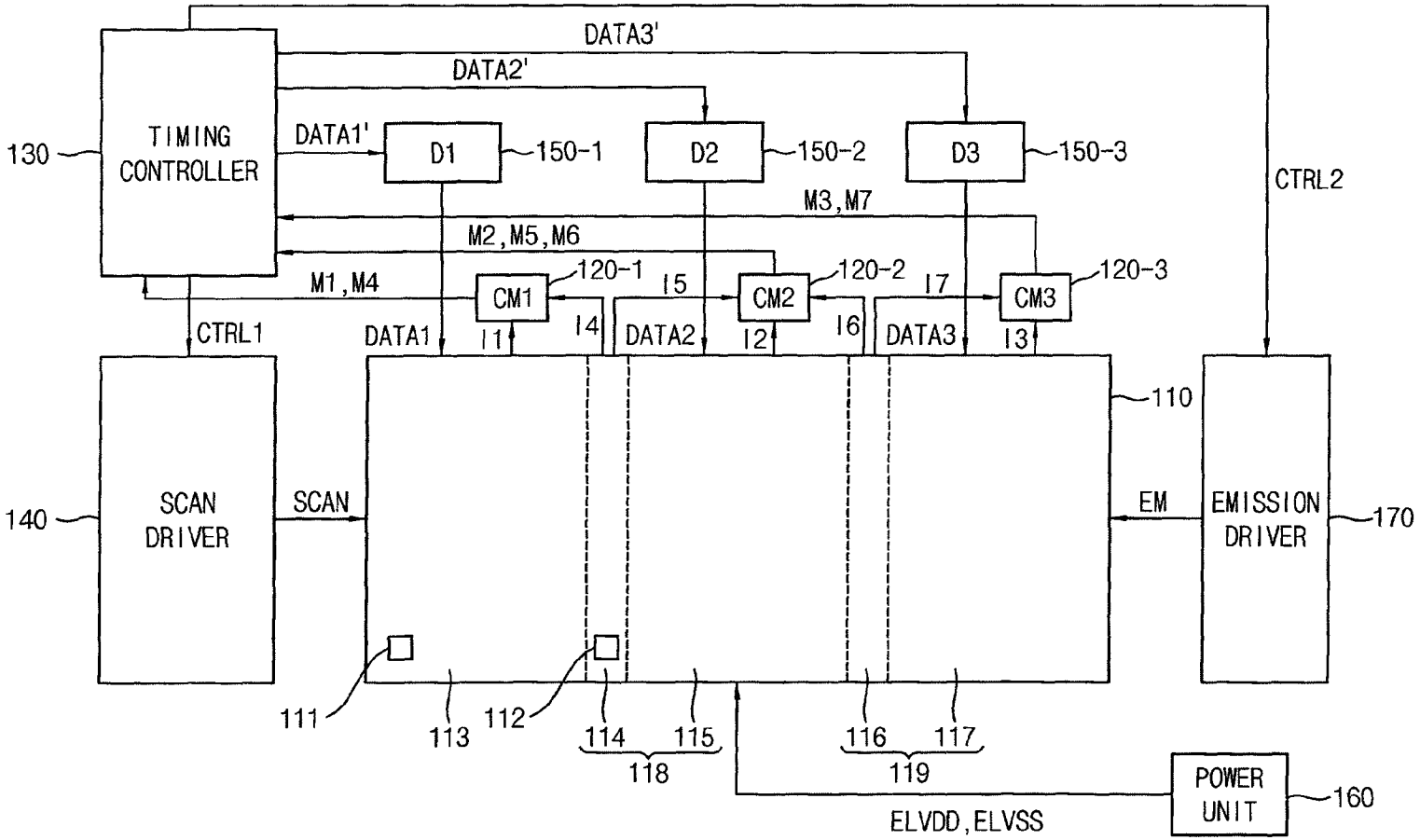
FIG. 1 illustrates an embodiment of an organic light emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

FIG. 1 illustrates an embodiment of an organic light emitting display device 100 which includes a display panel 110, first to (n)th current measuring units 120-1, 120-2, and 120-3, a timing controller 130, a scan driver 140, a data driver 150-1, 150-2, and 150-3, and a power unit 160. The organic light emitting display device may further include an emission driver 170.

The display panel 110 may include first to (n)th pixel blocks 113, 118, and 119, each having a plurality of pixels 111 and 112. The pixels 111 and 112 emit light based on a power voltage ELVDD and ELVSS and a voltage of a data signal DATA1 to DATA3. Each of the pixels 111 and 112 may include a driving current providing unit and an organic light emitting diode. The driving current providing unit generate driving current based on the voltage of the data signal DATA1 to DATA3 and the power voltage ELVDD and ELVSS provided to each pixel 111 and 112. The driving current providing unit may provide the driving current to the organic light emitting diode. As a result, the organic light emitting diode emits light based on the driving current. The luminance of light emitted from the organic light emitting diode increases as the driving current increases.

In one embodiment, the display panel 110 is divided into the first to (n)th blocks 113, 118, and 119. The second to (n)th blocks 118 and 119 may include overlapped blocks 114 and 116, at least one of which has an overlapped pixel 112. In FIG. 1, n is 3, and the display panel includes the first pixel block 113, the second pixel block 118, and the third pixel block 119. The second pixel block 118 may include the overlapped pixel 112 adjacent to the first pixel block 113. The third pixel block 119 may include an overlapped pixel adjacent to the second pixel block 118.

In one embodiment, the first to (n)th pixel blocks 113, 118, and 119 are arranged along a shorter side direction. The overlapped blocks 114 and 116 include a plurality of pixel columns. The overlapped pixel 112 may be included in one of the pixel columns. In another embodiment, the first to (n)th pixel blocks are arranged along a longer side direction. The overlapped blocks may include a plurality of pixel rows. The overlapped pixel may be included in one of the pixel rows.

The first to (n)th current measuring units 120-1, 120-2, and 120-3 may be connected to the first to (n)th pixel blocks 113, 118, and 119, respectively. The first to (n)th current measuring units 120-1, 120-2, and 120-3 may measure driving currents of the pixels in the first to (n)th pixel blocks 113, 118, and 119, respectively. For example, the first current measuring unit 120-1 may measure the driving current of the pixel in the first pixel block 113. The second current measuring unit 120-2 may measure the driving current of the pixel in the second pixel block 118. The third current measuring unit 120-3 may measure the driving current of the pixel in the third pixel block 119.

The first current measuring unit 120-1 may generate a first measured value M1, by measuring a first current I1 that is the driving current of the pixel in the first pixel block 113 within a non-emission period. In one embodiment, the non-emission period is in one horizontal period. The second current measuring unit 120-2 may generate a second measured value M2 and M5, by measuring second current I2 and I5 that is the driving current of the pixel in the second pixel block 118 within the non-emission period. The third current measuring unit 120-3 may generate a third measured value M3 and M7, by measuring a third current I3 and I7 that is the driving current of the pixel in the third pixel block 119 within the non-emission period. An example of the pixel having the driving current is explained with reference to FIGS. 2A and 2B.

A (k)th (k is an integer greater than 0 and smaller than n) current measuring unit among the first to (n)th current measuring units 113, 118, and 119 may measure the driving currents of the pixels 111 in a (k)th pixel block, among the first to nth pixel blocks 113, 118, and 119. The (k)th current measuring unit may further measure a driving current of at least one overlapped pixel among the pixels in a (k+1)th pixel block adjacent to the (k)th pixel block.

As illustrated in FIG. 1, the first to third current measuring units 120-1, 120-2, and 120-3 may measure the driving currents of the pixels in the first to third pixel blocks, respectively. Further, the first current measuring unit 120-1 may measure the driving current of the overlapped pixel 112 in the second pixel block 118 and adjacent to the first pixel block 113. The second current measuring unit 120-2 may measure the driving current of the overlapped pixel in the third pixel block 119 and adjacent to the second pixel block 118. The first current measuring unit 120-1 may generate not only the first measured value M1, but also a first overlapped pixel measured value M4, by measuring a first overlapped pixel current I4 that is the driving current of the overlapped pixel in the second pixel block 118 within the non-emission period. The second current measuring unit 120-2 may generate not only the second measured value M2 and M5, but also a second overlapped pixel measured value M6, by measuring a second overlapped pixel current I6 that is the driving current of the overlapped pixel in the third pixel block within the non-emission period.

The first to (n)th current measuring units 120-1, 120-2, and 120-3 may include semiconductor elements. The current measuring capability of the first to (n)th current measuring units 120-1, 120-2, and 120-3 may be different from each other, for example, according to a semiconductor manufacturing environment. Thus, the values measured by the first to (n)th current measuring units 120-1, 120-2, and 120-3 may be different, when the driving currents of all pixels are substantially the same.

For example, the first overlapped measured value M4 of the overlapped pixel 112 in the second pixel block 118 measured by the first current measuring unit 120-1 may be different from the second measured value M5 of the overlapped pixel 112 measured by the second current measuring unit 120-2. Similarly, the second overlapped pixel measured value M6 of the overlapped pixel included in the third pixel block 119 measured by the second current measuring unit 120-2 may be different from the third measured value M7 of the overlapped pixel measured by the third current measuring unit 120-3.

If the timing controller 130 adjusts the data signals DATA1 to DATA3 only based on the first to third measured values M1, M2, M3, M5, and M7 and ignores the first and second overlapped pixel measured values M4 and M6, the luminance of light emitted from boundaries between the pixel blocks 111, 118, and 119 may be significantly changed.

The timing controller 130 may adjust the data signals DATA1 to DATA3 applied to the pixels 111 and 112 based on the measured values M1 to M7 that are measured by the first to (n)th current measuring units 120-1, 120-2, and 120-3. The timing controller 130 may apply image data DATA1' to DATA3' to the first to (n)th data drivers 150-1, 150-2, and 150-3, respectively. The timing controller 130 may control the scan driver 140 based on a first control signal CTRL1 and may control the emission driver 170 based on a second control signal CTRL2.

In one embodiment, the timing controller 130 may adjust the data signals DATA1 to DATA3 based on the measured values M1 to M7, measured by the first to (n)th current measuring units 120-1, 120-2, and 120-3, to compensate a change of the driving current of each of the pixels 111 and 112. For example, the driving currents may decrease as the performance of the driving transistors in the pixels 111 and 112 deteriorate. Thus, the timing controller 130 may adjust the data signals DATA1 to DATA3 to compensate the driving currents.

In one embodiment, the timing controller 130 may adjust the driving current applying time within one horizontal period by adjusting the data signals DATA1 to DATA3. The driving current applying time may be a duration during which the driving current is applied to the organic light emitting diode in each of the pixels 111 and 112. In a digital driving manner, the organic light emitting display device 100 may display a gray scale value by controlling a light emitting duration of each of the pixels 111 and 112. Thus, the timing controller 130 may adjust the data signals DATA1 to DATA3 to control the light emitting duration of each of the pixels 111 and 112.

In another embodiment, the timing controller 130 may adjust voltage levels of the data signals DATA1 to DATA3. In an analog driving manner, the organic light emitting diode emits light with a gray scale value corresponding to the driving currents. The driving transistors in the pixels may generate the driving currents based on the voltage levels of the data signals DATA1 to DATA3, respectively. Thus, the timing controller 130 may adjust respective voltage levels of the signals DATA1 to DATA3.

According to at least one embodiment, the timing controller 130 may determine a driving current determining value for the overlapped pixel 112 based on the measured value (e.g., the first overlapped pixel measured value M4) of the overlapped pixel 112 measured by the (k)th current measuring unit and the measured value (e.g., the second measured value M5) of the overlapped pixel 112 measured by the (k+1)th current measuring unit adjacent to the (k)th current measuring unit. The data signal (e.g., the data signal DATA2) applied to the overlapped pixel 112 may be adjusted based on the driving current determining value.

As illustrated in FIG. 1, a driving current determining value of the overlapped pixel in the third pixel block 119 may be determined based on the second overlapped pixel measured value M6 by the second current measuring unit 120-2 and the third measured value M7 by the third current measuring unit 120-3. An example of the timing controller 130 determining the driving current determining value is explained with reference to FIG. 5.

In one embodiment, the timing controller 130 may determine the driving current determining value between the measured value (e.g., the first overlapped pixel measured value M4) measured by the (k)th current measuring unit and the measured value (e.g., the second measured value M5) measured by the (k+1)th current measuring unit. A difference between the driving current determining value and the measured value (e.g., the first overlapped pixel measured value M4) measured by the (k)th current measuring unit may decrease as a distance between the overlapped pixel 112 and the (k)th pixel block (e.g., the first pixel block 113) decreases.

For example, the timing controller 130 may determine the driving current determining value near to the measured value (e.g., the first overlapped pixel measured value M4) measured by the (k)th current measuring unit when the overlapped pixel is closer to the (k)th pixel block than the (k+1)th pixel block. The timing controller 130 may determine the driving current determining value near to the measured value (e.g., the second measured value M5) measured by the (k+1)th current measuring unit when the overlapped pixel is closer to the (k+1)th pixel block than the (k)th pixel block.

As illustrated in FIG. 1, the driving current determining value of the overlapped pixel 112 in the second pixel block 118 may be determined near to the first overlapped pixel measured value M4 measured by the first current measuring unit 120-1 when the overlapped pixel 112 is closer to the first pixel block 113 than the second pixel block 118, and may be determined near to the second measured value M5 measured by the second current measuring unit 120-2 when the overlapped pixel 112 is closer to the second pixel block 118 than the first pixel block 113.

Similarly, the driving current determining value of the overlapped pixel in the third pixel block 119 may be determined near to the second overlapped pixel measured value M6 measured by the second current measuring unit 120-2 when the overlapped pixel is closer to the second pixel block 118 than the third pixel block 119, and may be determined near to the third measured value M7 measured by the third current measuring unit 120-3 when the overlapped pixel 112 is closer to the third pixel block 119 than the second pixel block 118.

In one embodiment, the timing controller 130 may determine the driving current determining value based on a sum of a first value and a second value. The first value may be calculated by multiplying the measured value measured by the (k)th current measuring unit (e.g., the measured value M4 or M6) by a first weight being multiplied to the measured value measured by the (k)th current measuring unit (e.g., the measured value M4 or M6). The second value may be calculated by the (k+1)th current measuring unit (e.g., the overlapped pixel measured value M5 or M7) by a second weight. The first weight may increase as a distance between the overlapped pixel (e.g., the overlapped pixel 112) and the (k)th pixel block (e.g., the first pixel block 113) decreases. The second weight may increase as the distance between the overlapped pixel (e.g., the overlapped pixel 112) and the (k)th pixel block (e.g., the first pixel block 113) increases. That is, the first weight may increase as the overlapped pixel (e.g., the overlapped pixel 112) is closer to the (k)th pixel block (e.g., the first pixel block 113) and the second weight may increase as the overlapped pixel (e.g., the overlapped pixel 112) is farther to the (k)th pixel block (e.g., the first pixel block 113).

The value measured by the (k)th current measuring unit may be a factor to determine the driving current determining value when the first weight increases and the second weight decreases. On the other hand, the measured value by the (k+1)th current measuring unit may be a factor to determine the driving current determining value when the first weight decreases and the second weight increases.

The scan driver 140 generates scan signals and applies the scan signals to the pixels 111 and 112, respectively. The scan driver 140 may be controlled by the first control signal CTRL1 from the timing controller 130.

The organic light emitting display device 100 may include the first to (n)th data drivers 150-1, 150-2, and 150-3. In one embodiment, the first to (n)th data drivers 150-1, 150-2, and 150-3 may be connected to the first to nth pixel blocks 113, 118, and 119, respectively. The first to (n)th data drivers 150-1, 150-2, and 150-3 may apply the data signals DATA1 to DATA3 to the pixels in the first to (n)th pixel blocks 113, 118, and 119.

In one embodiment, the pixels in the first to the (n)th pixel blocks 113, 118, and 119 may receive the data signals DATA1 to DATA3 from the first to (n)th data drivers 150-1, 150-2, and 150-3 through a plurality of data lines, respectively. The first to (n)th current measuring units 120-1, 120-2, and 120-3 may measure the driving currents of the pixels via the data lines, respectively. In one embodiment, the (k)th current measuring unit may further measure the driving current of the at least one overlapped pixel via at least one data line corresponding to the (k+1)th pixel block. In one example embodiment, the first to (n)th data drivers 150-1, 150-2, and 150-3 may include the first to (n)th current measuring units 120-1, 120-2, and 120-3, respectively.

The power unit 160 may apply a power voltage ELVDD and ELVSS to the pixels 111 and 112. In one example embodiment, the power unit 160 may apply voltages to the scan driver 140, the first to (n)th data drivers 150-1, 150-2, and 150-3, and the emission driver 170.

The emission driver 170 may generate emission signals EM, and apply the emission signals EM to the pixels. The emission driver 170 may be controlled by the second control signal CTRL2 from the timing controller 130.

As described above, the organic light emitting display device 100 may adjust the data signals DATA1 to DATA3 based on the measured values by the first to (n)th current measuring units 120-1, 120-2, and 120-3, so that a decrease of the driving currents caused by degradation of the driving transistors may be compensated. Further, two neighboring current measuring units (e.g., the (k)th current measuring unit and the (k+1)th current measuring unit) may measure the driving current of the overlapped pixel 112, so that a sudden luminance change at the boundaries between the pixel blocks 111, 118, and 119 may decrease.

Figure 2A:
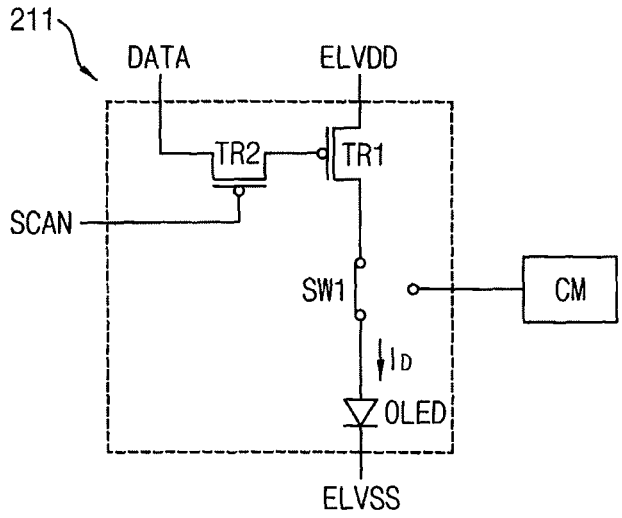
FIG. 2A illustrates an embodiment of a pixel driven during an emission period.
Figure 2B:
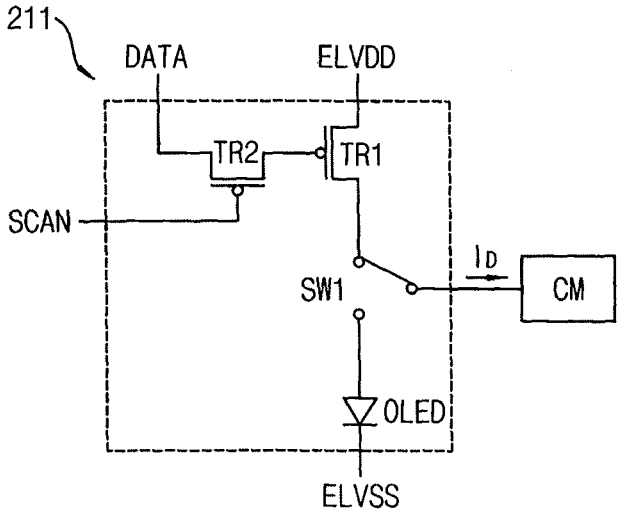
FIG. 2B illustrates the pixel during a non-emission period.

FIG. 2A illustrates an example of a pixel 211 which emits light based on a driving current during an emission period. FIG. 2B illustrates an example of the extraction of a driving current from the pixel 211 during a non-emission period.

Referring to FIGS. 2A and 2B, the pixel 211 includes a driving transistor TR1, a switching transistor TR2, a driving current extracting switch SW1, and an organic light emitting diode OLED. The switching transistor TR2 receives a data signal DATA. The switching transistor TR2 applies the data signal DATA to a gate electrode of the driving transistor TR1 based on a scan signal. The driving transistor TR1 generates the driving current ID based on the data signal DATA and a first power voltage ELVDD. In one example embodiment, the emission period and the non-emission period may be included in one horizontal period.

Further, as illustrated in FIG. 2A, the driving current extracting switch SW1 connects the driving transistor TR1 to the organic light emitting diode OLED during the emission period. Thus, the driving current ID flows to a second power voltage ELVSS via the organic light emitting diode OLED. The organic light emitting diode OLED emits light based on the driving current ID.

Further, as illustrated in FIG. 2B, the driving current extracting switch SW1 connects the driving transistor TR1 to a current measuring unit CM outside of the pixel 211 during the non-emission period. Thus, the driving current ID is extracted outside of the pixel 211, and the current measuring unit CM measures the extracted driving current ID. The structure of the pixel 211 may be different in other embodiments.

Figure 3:
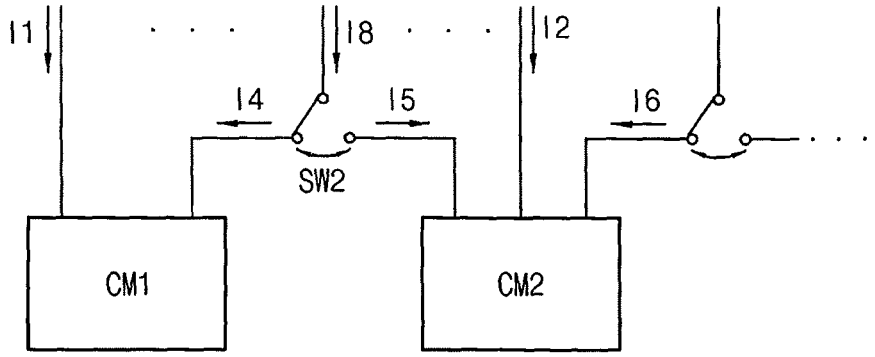
FIG. 3 illustrates a first current measuring unit and a second measuring unit that alternately measure a driving current of an overlapped pixel.

FIG. 3 illustrates an example where a first current measuring unit and a second measuring unit alternately measure a driving current of an overlapped pixel. Referring to FIGS. 1 and 3, the first current measuring unit CM1 measures a first current I1 and a first overlapped pixel current I4. The second current measuring unit CM2 measures a second current I2 and I5 and a second overlapped pixel current I6. A connecting switch SW2 applies a driving current I8 extracted from the overlapped pixel (e.g., the overlapped pixel 122 of FIG. 1) to the first current measuring unit CM1 as the first overlapped pixel current I4 or to the second current measuring unit CM2 as the second overlapped pixel current I6. The connection switch SW2 applies the extracted driving current I8 to the first current measuring unit CM1, to allow the first current measuring unit CM1 to measure the first overlapped pixel current I4. Similarly, the second current measuring unit CM2 measures the second overlapped pixel current I6.

The connection switch SW2 applies the extracted driving current I8 to the second current measuring unit CM2, such that the second current measuring unit CM2 measures the second current I4. As described above, a portion of a current path where the extracted driving current of the overlapped pixel flows is shared so that inner space of the display panel may be utilized effectively.

Figure 4:
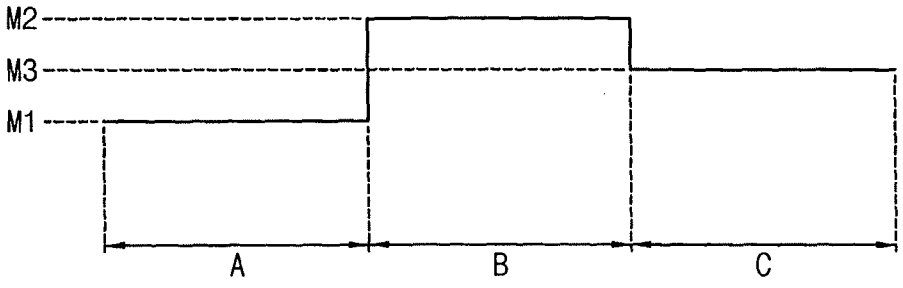
FIG. 4 illustrates an example of values of pixels measured by first to third current measuring units when all the pixels receive a same driving current.
Figure 5:
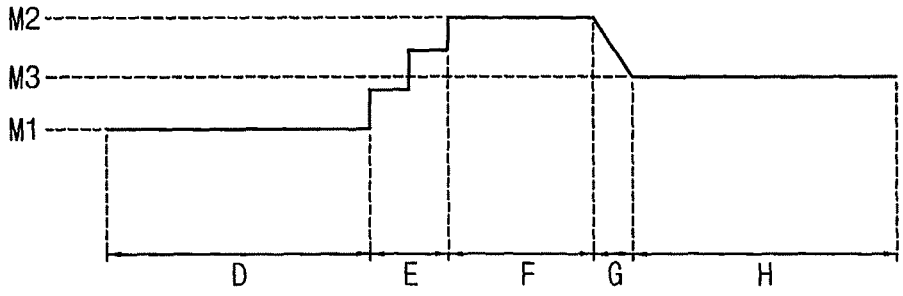
FIG. 5 illustrates an example of driving current determining values of overlapped pixels and measured values of pixels when all the pixels receive a same driving current.

FIG. 4 illustrates an example of values of pixels measured by first to third current measuring units, according to a longer side direction of a display panel of the organic light emitting display device in FIG. 1, when all the pixels receive the same driving currents. FIG. 5 illustrates an example of driving current determining values of overlapped pixels and measured values of pixels, according to a longer side direction of a display panel of the organic light emitting display device in FIG. 1, when all the pixels receive the same driving currents.

Referring to FIGS. 1 and 4, all the pixels in the display panel may generate the same driving currents. The first current measuring unit 120-1 measures a first measured value M1 of a first pixel block A. The second current measuring unit 120-2 measures a second measured value M2 of a second pixel block B. The third current measuring unit 120-3 measures a third measured value M3 of a third pixel block C. A difference between the first measured value M1 and the second measured value M2 (i.e., M2−M1) may occur at a boundary between the first pixel block A and the second pixel block B. A difference between the second measured value M2 and the third measured value M3 may occur (i.e., M2−M3) at a boundary between the second pixel block B and the third pixel block C. If the timing controller 130 adjusts the data signals DATA1 to DATA3 only based on the first to third measured values M1, M2, and M3, and ignores the first and second overlapped pixel measured values M4 and M6, the luminance of light emitted from the boundaries may unexpectedly change. The luminance change at the boundaries may be visible in some cases.

Referring to FIG. 5, a driving current determining value of a first pixel block D may be determined by the first measured value M1. A second pixel block E and F may include an overlapped block E and a remaining block F. A third pixel block G and H may include a overlapped block G and a remaining block H. A driving current determining value of the remaining block F of the second pixel block may be determined by the second measured value M2. A driving current determining value of the remaining block H of the third pixel block may be determined by the third measured value M3. A driving current determining value of the overlapped block E of the second pixel block may be determined based on the first measured value M1 and the second measured value M2. A driving current determining value of the overlapped block G of the third pixel block may be determined based on the second measured value M2 and the third measured value M3.

The driving current determining value of the overlapped block E of the second pixel block may be between the first measured value M1 and the second measured value M2. The driving current determining value of the overlapped block G of the third pixel block may be between the second measured value M2 and the third measured value M3.

As illustrated in FIG. 5, the driving current determining value may change from the first measured value M1 to the second measured value M2, having a discontinuous form according to a position of the overlapped pixel in the overlapped block E. The driving current determining value may change from the second measured value M2 to the third measured value M3, having a continuous form according to a position of the overlapped pixel in the overlapped block G. The driving current determining value may change in a different manner in other embodiments.

The data signals applied to the pixels may be adjusted based on the driving current determining values, so that a sudden luminance change at boundaries between the pixel blocks may be prevented.

Figure 6:
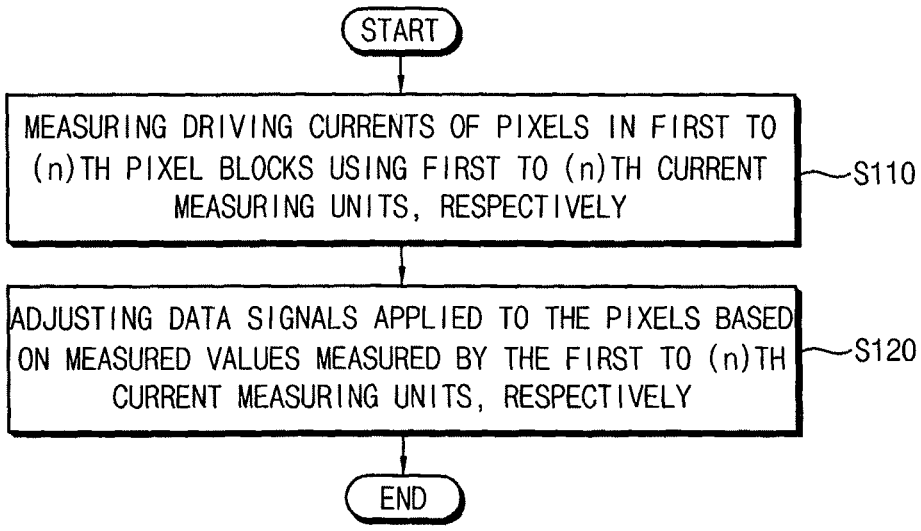
FIG. 6 illustrates an embodiment of a method for driving an organic light emitting display device.

FIG. 6 illustrates an embodiment of a method for driving an organic light emitting display device. The organic light emitting display device may include a display panel including first to (n)th pixel blocks, each having a plurality of pixels. The method includes measuring driving currents using first to (n)th current measuring units S110, and adjusting data signals applied to the pixels S120.

The first to (n)th current measuring units may measure the driving currents of pixels in the first to (n)th pixel blocks, respectively S110. A (k)th (k is an integer greater than 0 and smaller than n) current measuring unit among the first to (n)th current measuring units may measure driving currents of the pixels in a (k)th pixel block, among the first to nth pixel blocks, and may also measure a driving current of at least one overlapped pixel among the pixels in a (k+1)th pixel block adjacent to the (k)th pixel block.

The data signals applied to the pixels may be adjusted based on measured values measured by the first to (n)th current measuring units S120.

In an example embodiment, the data signals may be adjusted based on the values measured by the first to (n)th current measuring units, to compensate a change of the driving current of each of the pixels. For example, the driving currents may decrease as the performance of the driving transistors in the pixels deteriorates. Thus, the data signals DATA1 to DATA3 may be adjusted to compensate the driving currents.

In one example embodiment, a driving current applying time may be adjusted within one horizontal period by adjusting the data signals. The driving current applying time may be a duration during which the driving current is applied to an organic light emitting diode in each of the pixels. In a digital driving manner, the organic light emitting display device may display a gray scale value by controlling a light emitting duration of each of the pixels. Thus, the data signals may be adjusted to control the light emitting duration of each of the pixels.

In another example embodiment, respective voltage levels of the data signals may be adjusted. In an analog driving manner, the organic light emitting diode emits light with a gray scale value corresponding to the driving currents. The driving transistors in the pixels may generate the driving currents based on the voltage levels of the data signals, respectively. Thus, respective voltage levels of the data signals may be adjusted.

In an example embodiment, a driving current determining value for the overlapped pixel may be determined based on a measured value of the overlapped pixel, that is measured by the (k)th current measuring unit, and a measured value of the overlapped pixel, that is measured by a (k+1)th current measuring unit adjacent to the (k)th current measuring unit. A data signal applied to the overlapped pixel may be adjusted based on the driving current determining value.

In an example embodiment, the driving current determining value may be between the measured value measured by the (k)th current measuring unit and the measured value measured by the (k+1)th current measuring unit. A difference between the driving current determining value and the measured value measured by the (k)th current measuring unit decreases as a distance between the overlapped pixel and the (k)th pixel block decreases. For example, the driving current determining value may be determined near the measured value measured by the (k)th current measuring unit when the overlapped pixel is nearer to the (k)th pixel block than the (k+1)th pixel block, and may be determined near the measured value measured by the (k+1)th current measuring unit when the overlapped pixel is nearer to the (k+1)th pixel block than the (k)th pixel block.

In an example embodiment, the driving current determining value may be determined based on a sum of a first value and a second value. The first value may be calculated by multiplying the measured value measured by the (k)th current measuring unit by a first weight. The second value may be calculated by multiplying the measured value measured by the (k+1)th current measuring unit by a second weight. The first weight may increase as a distance between the overlapped pixel and the (k)th pixel block decreases. The second weight may increase as the distance between the overlapped pixel and the (k)th pixel block increases.

For example, the first weight may increase as the overlapped pixel is nearer to the (k)th pixel block. The second weight may increase as the overlapped pixel is farther to the (k)th pixel block. The measured value by the (k)th current measuring unit may be a factor to determine the driving current determining value when the first weight increases and the second weight decreases. On the other hand, the measured value by the (k+1)th current measuring unit may be a factor to determine the driving current determining value when the first weight decreases and the second weight increases.

In an example embodiment, the pixels in the first to the (n)th pixel blocks may receive the data signals from the first to (n)th data drivers through a plurality of data lines, respectively. The first to (n)th current measuring units may measure the driving currents of the pixels via the data lines, respectively. In one example embodiment, the (k)th current measuring unit may further measure the driving current of the at least one overlapped pixel via at least one data line corresponding to the (k+1)th pixel block. In one example embodiment, the first to (n)th data drivers may include the first to (n)th current measuring units, respectively.

As described above, the method of the organic light emitting display device may adjust the data signals based on values measured by the first to (n)th current measuring units, so that a decrease of driving currents caused by degradation of driving transistors may be compensated. Further, two neighboring current measuring units (e.g., the (k)th current measuring unit and the (k+1)th current measuring unit) may measure the driving current of the overlapped pixel, so that a sudden luminance change at boundaries between pixel blocks may decrease.

One or more of the aforementioned embodiments include a display panel divided to first to third pixel blocks. In other embodiments, the display panel may have a different number of pixel blocks.

The present embodiments may be applied to any display device and any system that includes or uses an organic light emitting display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

By way of summation and review, in accordance with one or more of the aforementioned embodiments, an organic light emitting display device includes a plurality of current measuring units. A (k)th current measuring unit measures driving currents of the pixels in a (k)th pixel block, and further measures a driving current of at least one overlapped pixel among the pixels in a (k+1)th pixel block adjacent to the (k)th pixel block. Thus, the organic light emitting display device may compensate the driving current based on the measured values of the overlapped pixel by the current measuring units, so that side effects from the deterioration of the driving transistor may remarkably decrease.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in foam and details may be made without departing from the spirit and scope of the present invention as set forth in the following claims.

What is claimed is:

1. An organic light emitting display device, comprising:

a display panel including first to (n)th pixel blocks, each of the first to (n)th pixel blocks having a plurality of pixels and where n>1;

first to (n)th current measuring circuits respectively connected to the first to nth pixel blocks, the first to (n)th current measuring circuits to measure driving currents of the pixels in the first to (n)th pixel blocks, respectively; and a timing controller to adjust data signals applied to the pixels based on values measured by the first to (n)th current measuring circuits, wherein a (k)th current measuring circuit among the first to (n)th current measuring circuits is to measure driving currents of the pixels in a (k)th pixel block among the first to (n)th pixel blocks, and is to measure a driving current of at least one overlapped pixel among the pixels in a (k+1)th pixel block that is adjacent to the (k)th pixel block, where 0<k<n.

2. The device as claimed in claim 1, wherein the timing controller is to adjust the data signals based on the values measured by the first to (n)th current measuring circuits to compensate a change of the driving current of each of the pixels.

3. The device as claimed in claim 1, wherein the timing controller is to adjust a driving current applying time within one horizontal period by adjusting the data signals, wherein the driving current applying time includes a duration of time during which the driving current is applied to an organic light emitting diode (OLED) in each of the pixels.

4. The device as claimed in claim 1, wherein the timing controller is to adjust respective voltage levels of the data signals.

5. The device as claimed in claim 1, further comprising:

first to (n)th data drivers respectively connected to the first to nth pixel blocks, the first to (n)th data drivers to apply the data signals to the pixels in respective ones of the first to (n)th pixel blocks.

6. The device as claimed in claim 1, wherein:

the pixels in the first to (n)th pixel blocks are to receive the data signals from the first to (n)th data drivers through respective data lines, respectively, and the first to (n)th current measuring circuits are to measure the driving currents via the data lines.

7. The device as claimed in claim 6, wherein the (k)th current measuring circuit is to measure the driving current of the at least one overlapped pixel via at least one data line corresponding to the (k+1)th pixel block.

8. The device as claimed in claim 1, wherein the timing controller is to determine a driving current determining value for the overlapped pixel based on a value of the overlapped pixel measured by the (k)th current measuring circuit and a value of the overlapped pixel measured by a (k+1)th current measuring circuit adjacent to the (k)th current measuring circuit, wherein a data signal to be applied to the overlapped pixel is adjusted based on the driving current determining value.

9. The device as claimed in claim 8, wherein:

the timing controller is to determine the driving current determining value between the value measured by the (k)th current measuring circuit and the value measured by the (k+1)th current measuring circuit, and a difference between the driving current determining value and the value measured by the (k)th current measuring circuit decreases as a distance between the overlapped pixel and the (k)th pixel block decreases.

10. The device as claimed in claim 8, wherein:

the timing controller is to determine the driving current determining value based on a sum of a first value and a second value, the first value is to be determined based on a product of the value measured by the (k)th current measuring circuit and a first weight, the second value is to be determined based on a product of the value measured by the (k+1)th current measuring circuit and a second weight, the first weight increases as a distance between the overlapped pixel and the (k)th pixel block decreases, and the second weight increases as the distance between the overlapped pixel and the (k)th pixel block increases.

11. A method for driving an organic light emitting display device, the method comprising:

measuring driving currents of pixels in first to (n)th pixel blocks of the display device using first to (n)th current measuring circuits, respectively; and adjusting data signals applied to the pixels based on values measured by the first to (n)th current measuring circuits, wherein a (k)th current measuring circuit among the first to (n)th current measuring circuits is to measure driving currents of the pixels in a (k)th pixel block among the first to (n)th pixel blocks, and is to measure a driving current of at least one overlapped pixel among the pixels in a (k+1)th pixel block that is adjacent to the (k)th pixel block, where 0<k<n.

12. The method as claimed in claim 11, wherein adjusting the data signals includes adjusting the data signals based on the values measured by the first to (n)th current measuring circuits, to compensate a change of the driving current of each of the pixels.

13. The method as claimed in claim 11, further comprising:

adjusting a driving current applying time within one horizontal period by adjusting the data signals, wherein the driving current applying time includes a time having a duration during which the driving current is applied to an organic light emitting diode (OLED) in each of the pixels.

14. The method as claimed in claim 11, wherein respective voltage levels of the data signals are adjusted.

15. The method as claimed in claim 11, further comprising:

applying the data signals to the pixels in the first to (n)th pixel blocks from first to (n)th data drivers, respectively.

16. The method as claimed in claim 11, wherein:

the pixels in the first to (n)th pixel blocks receive the data signals from the first to (n)th data drivers through a plurality of data lines, respectively, and the first to (n)th current measuring circuits measure the driving currents via the data lines.

17. The method as claimed in claim 16, further comprising:

measuring the driving current of the at least one overlapped pixel using the (k)th current measuring circuit, the driving current of the at least one overlapped pixel measured via at least one data line corresponding to the (k+1)th pixel block.

18. The method as claimed in claim 11, further comprising:

determining a driving current determining value for the overlapped pixel based on a value of the overlapped pixel measured by the (k)th current measuring circuit and a value of the overlapped pixel measured by a (k+1)th current measuring circuit adjacent to the (k)th current measuring circuit, wherein a data signal applied to the overlapped pixel is adjusted based on the driving current determining value.

19. The method as claimed in claim 18, further comprising:

determining the driving current between the value measured by the (k)th current measuring circuit and the value measured by the (k+1)th current measuring circuit, wherein a difference between the driving current determining value and the value measured by the (k)th current measuring circuit decreases as a distance between the overlapped pixel and the (k)th pixel block decreases.

20. The method as claimed in claim 18, further comprising:

determining a first value based on a product of the value measured by the (k)th current measuring circuit and a first weight, determining a second value based on a product of the value measured by the (k+1)th current measuring circuit and a second weight, and determining the driving current determining value based on a sum of the first value and the second value, wherein the first weight increases as a distance between the overlapped pixel and the (k)th pixel block decreases, and wherein the second weight increases as the distance between the overlapped pixel and the (k)th pixel block increases.

* * * * *